US005368197A

United States Patent [19]

Sutera

[11] Patent Number: 5,368,197

[45] Date of Patent: Nov. 29, 1994

[54] SELF-FILLING BOTTLED-WATER COOLER CONVERSION KIT

[76] Inventor: Carl M. Sutera, 380 Bearhill Rd., North Andover, Mass. 01845

[21] Appl. No.: 780,880

[22] Filed: Oct. 18, 1991

Related U.S. Application Data

[63] Continuation-in-part of Ser. No. 541,775, Jun. 21, 1990, Pat. No. 5,114,042.

[51] Int. Cl.[5] ..... B67D 5/08

[52] U.S. Cl. ..... 222/67; 222/185; 222/542

[58] Field of Search ..... 222/64, 67, 146.6, 185, 222/189, 542; 62/397, 398, 390, 391; 277/207 A; 215/341, 345

[56] References Cited

U.S. PATENT DOCUMENTS

| | | | |
|---|---|---|---|
| 738,712 | 9/1903 | Cole | 62/397 |
| 1,228,836 | 6/1917 | Schulse | 222/185 |
| 1,368,703 | 2/1921 | Czerny | 222/185 |
| 1,398,348 | 11/1921 | Weber et al. | 62/397 |
| 1,823,379 | 9/1931 | Schmidt | 222/67 |
| 1,834,672 | 12/1931 | Austin | 222/185 |
| 2,020,884 | 11/1935 | Garcia | 222/185 |
| 2,270,519 | 1/1942 | Fisher | 277/207 A X |
| 3,031,860 | 5/1962 | Middleton | 62/189 |
| 3,052,377 | 9/1962 | Bill | 222/67 |
| 3,327,485 | 6/1967 | Bush | 62/3 |
| 3,363,432 | 1/1968 | Sholtes | 62/397 |
| 3,365,904 | 1/1968 | Ross | 62/177 |
| 3,367,133 | 2/1968 | Dreis et al. | 62/390 |
| 3,468,370 | 9/1969 | Castillo | 165/66 |
| 3,495,612 | 2/1970 | Moreland, II et al. | 137/209 |
| 3,541,808 | 11/1970 | Materese | 62/397 |
| 3,572,553 | 3/1971 | Ogden | 222/67 |
| 3,688,950 | 9/1972 | Parish | 222/146 R |
| 3,731,845 | 5/1973 | Booth | 222/67 |
| 3,824,801 | 7/1974 | Laudato, Jr. | 62/201 |
| 3,845,884 | 11/1974 | Hall et al. | 222/173 |
| 3,921,855 | 11/1975 | Syverson | 222/67 |
| 4,565,381 | 1/1986 | Joelson | 277/207 A |
| 4,575,615 | 3/1986 | Shigenobu et al. | 219/314 |
| 4,597,509 | 7/1986 | Pereira | 222/129 |
| 4,649,809 | 3/1987 | Kanezashi | 99/290 |
| 4,699,188 | 10/1987 | Baker et al. | 141/18 |
| 4,728,005 | 3/1988 | Jacobs et al. | 222/64 |
| 4,757,921 | 7/1988 | Snowball | 222/146.6 |
| 4,779,426 | 10/1988 | Desrosiers | 62/390 |
| 4,792,059 | 12/1988 | Kerner et al. | 222/67 |
| 4,801,375 | 1/1989 | Padilla | 210/100 |
| 4,808,346 | 2/1989 | Strenger | 261/18.1 |
| 4,834,267 | 5/1989 | Schroer et al. | 222/185 |
| 4,881,661 | 11/1989 | Jones | 222/67 |
| 4,923,091 | 5/1990 | Sutera | 222/67 |
| 4,958,747 | 9/1990 | Sheets | 222/67 |
| 5,003,790 | 4/1991 | Goupil | 62/397 X |
| 5,064,096 | 11/1991 | Illing | 222/185 X |
| 5,111,966 | 5/1992 | Fridman | 222/67 X |

FOREIGN PATENT DOCUMENTS

| | | | |
|---|---|---|---|
| 564565 | 3/1931 | Germany | 222/185 |
| 95247 | 3/1921 | Switzerland | 222/67 |
| 236688 | 7/1925 | United Kingdom | 222/65 |
| 2045730 | 12/1980 | United Kingdom | 222/542 |

OTHER PUBLICATIONS

Water Conditioning & Purificaton; *Buyer's Guide* (Apr. 1989), p. 45 Advertisement.

*Primary Examiner*—Andres Kashnikow
*Assistant Examiner*—Kenneth Bomberg

[57] ABSTRACT

An apparatus for converting a conventional bottle-water cooler into a self-filling bottles water cooler is provided. The apparatus includes a water bottle, a water inlet system, a venting system and a seal. In one embodiment, the seal is flat with a central opening which is stretched over the neck of the bottle and released, which allows the disk to assume a cylindrical configuration in engagement with the outer surface of the neck. The neck with the seal is then fimly pressed inside the water tank. In another embodiment, the seal includes rounded ridges disposed concentrically on one side of the seal with the ridges being successively wider and thicker towards the outermost edge of the seal.

6 Claims, 8 Drawing Sheets

FIG. 9
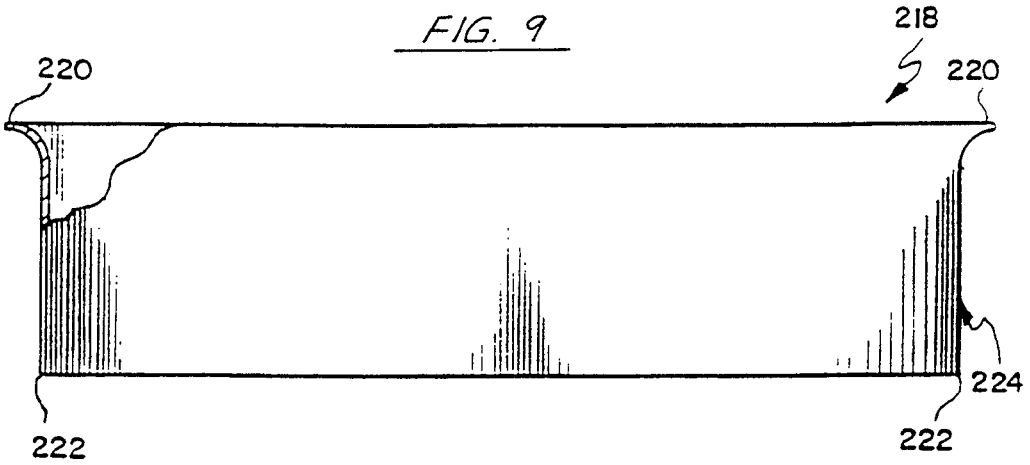
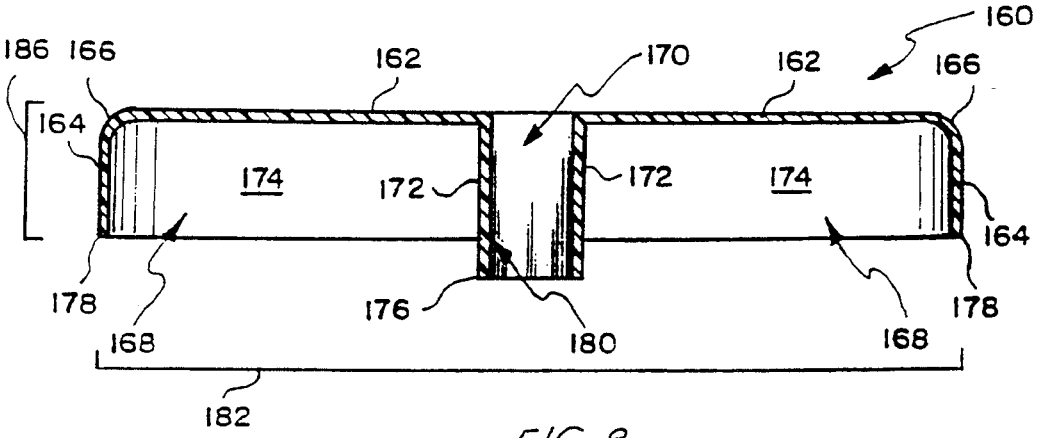
FIG. 8
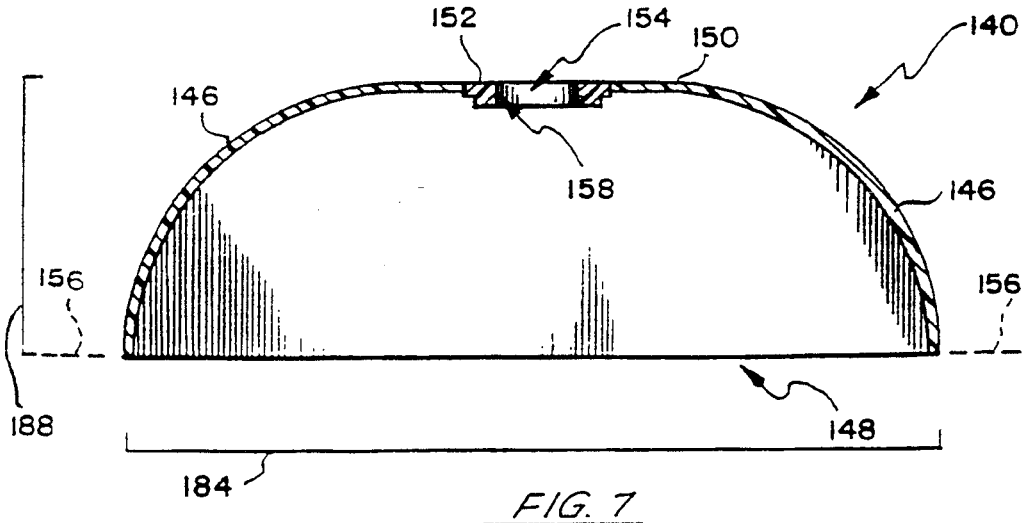
FIG. 7

SELF-FILLING BOTTLED-WATER COOLER CONVERSION KIT

CROSS REFERENCE TO RELATED APPLICATIONS

This invention is a continuation-in-part of patent application Ser. No. 07/521,775, filed Jun 21, 1990, now U.S. Pat. No. 5,114,042, issued May 19, 1992, entitled "Self-Filling Bottled-Water Cooler Conversion Kit."

FIELD OF THE INVENTION

The present invention generally relates to water coolers, and more particularly to a self-filling bottled-water cooler.

BACKGROUND OF THE INVENTION

Bottled-water coolers are found in homes, offices and other locations where pure drinking water is desired. Typically, bottled-water coolers are comprised of a cooling-dispersing unit and an interchangeable glass or plastic water-filled bottle mounted in an inverted position on the top of the cooling-dispensing unit. Pure drinking water is supplied in the interchangeable bottle, cooled in the cooling-dispensing unit and dispensed through a manually operated tap on the cooling-dispersing unit. When the water is completely dispensed from the cooler, the empty bottle is manually replaced with a filled bottle by removing the empty bottle and inverting the filled bottle onto the top of the cooling-dispensing unit.

Conventional bottled-water coolers, however, have a number of inherent limitations and disadvantages. The water supply is not continuous and therefore requires the difficult and time consuming task of removing empty bottles and replacing them with heavy, filled bottles. Changing the bottles can be particularly difficult for small persons or persons of limited strength. Furthermore, water is often spilled when the bottles are changed. Therefore, the bottles of conventional water coolers cannot be changed without risk of wetting the areas around the coolers or the persons changing the bottles. Also, conventional bottled-water coolers cannot be placed in a location where water spillage could cause damage. Conventional water coolers, therefore, can be messy and wasteful.

As the water supply in conventional bottled-water coolers is not continuous, conventional bottled-water coolers also cannot be used during the times they are empty. Users must wait until the bottles are changed. Frequently, this means that users of conventional water coolers must wait until persons can be found to change the bottles of the coolers or until new shipments of filled bottles arrive for the coolers.

Bottle-less water coolers overcome some of the disadvantages of conventional bottled-water coolers. In bottle-less water coolers, water is continuously pumped or otherwise supplied from a pure water source into a cooling-dispensing unit similar to the cooling-dispensing unit of a conventional bottled-water cooler. Because the water is pumped from a continuous source and a bottle is not needed, bottle-less water coolers, as their name implies, do not employ bottles to store the pure water.

Because bottle-less water coolers do not employ filled water bottles, they also have a number of inherent disadvantages. People associate water coolers with conventional bottled-water coolers. When people think of water coolers, they think of conventional bottled-water coolers. It is the water bottle on the top of the cooler that most indicates to the public that the unit is a water cooler. Therefore, a bottle-less water cooler is less easily recognized by the public as a water cooler.

Bottle-less water coolers are also less psychologically attractive to the public than bottled-water coolers. The public associates the quality of water dispensed by a conventional bottled-water cooler with the pure, crystal-clear look of the water in the bottle above the cooling-dispensing unit. The pure, crystal-clear appearance of the water in the bottle reminds the user that the cooler only dispenses pure water. A water cooler without a bottle displaying pure water, however, appears to dispense little more than tap water and does not provide the psychological assurance provided by conventional bottled-water coolers that pure water, rather than tap water, is being dispensed. Therefore, bottle-less water coolers are less popular with the public than bottled-water coolers.

SUMMARY OF THE INVENTION

To overcome the inherent disadvantages and limitations, and yet to combine the advantages of conventional bottled-water coolers and bottle-less water coolers, a self-filling bottled-water cooler is provided.

The self-filling bottled-water cooler includes a free--standing cabinet body having a water tank within the upper portion of the cabinet body. A transparent water bottle is securely attached in an inverted position on the top of the cabinet body to the water tank such that water freely flows between the bottle and the water tank.

Water is provided to the cooler from a tap-water or other continuous water source. The water is purified by a reverse osmosis, carbon block or other purifier and is then transferred to an inlet valve which regulates the flow of water into the water tank. The inlet valve is biased to an open position but can be closed to stop the flow of purified water into the water tank.

The self-filling bottled-water cooler also includes a float mechanism disposed within the water bottle. The float mechanism is connected to the inlet valve and closes the valve when the level of purified water in the bottle rises to a desired full level.

The purified water passes through the inlet valve and fills the water tank and the water bottle. When the purified water level reaches the desired full level, buoyancy causes the float mechanism to close the inlet valve to stop the flow of purified water into the water tank and the bottle.

The purified water is dispensed from the water tank of the cooler through one or more taps connected to the water tank and mounted on the cabinet body. Cooling and heating systems can be included in the cooler to vary the temperature of the pure water dispensed through the taps.

The self-filling bottled-water cooler also includes a venting system which prevents overfilling of the water bottle and vents the air space within the water bottle above the purified water level to prevent a change in air pressure in the air space. The venting systems includes a check valve and a bacteria filter to prevent contaminants from entering the water supply through the venting system.

The present invention provides a continuous supply of clear, pure water. Water cooler service is not interrupted and the bottle of the cooler is not changed. Therefore, a time-consuming, potentially messy and wasteful operation is not needed to maintain the water supply. Because the present invention resembles a conventional water cooler, it is easily recognized as a water cooler and possesses the psychological benefits conventional bottled-water coolers have over bottle-less walter coolers.

To also overcome the inherent disadvantages and limitations and yet to combine the advantages of conventional bottled-water coolers and bottle-less water coolers, an apparatus for converting a conventional bottled-water cooler into a self-filling bottled-water cooler is provided. In the conversion apparatus, the water bottle, inlet valve, float mechanism and venting system of the self-filling bottled water cooler described above are combined into a single unit which is used to replace the interchangeable bottle of a conventional bottled-water cooler. The conversion apparatus attaches to the water tank of the conventional bottled-water cooler, and the inlet valve of the conversion apparatus is connected to a water purifier and a continuous water source as described above. The conversion apparatus thus combines with the cabinet body of the conventional bottled-water cooler to form a self-filling bottled-water cooler as described above. A conventional bottled-water cooler converted to a self-filling bottled-water cooler with the conversion apparatus functions in the same manner as described above for a self-filling bottled-water cooler.

BRIEF DESCRIPTION OF THE DRAWINGS

A more complete understanding of the present invention and its attendant advantages and features thereof will be more readily understood by reference to the following detailed description when considered in conjunction with the accompanying drawings, wherein:

FIG. 7 is a cross-section view of the umbrella float of the apparatus of FIG. 4;

FIG. 8 is a cross-section view of an alternative embodiment of the umbrella float of FIG. 7;

FIG. 9 is a plan view of an adapter which can be used in conjunction with the apparatus of FIG. 4;

DETAILED DESCRIPTION OF THE PREFERRED EMBODIMENTS

Figure 1:
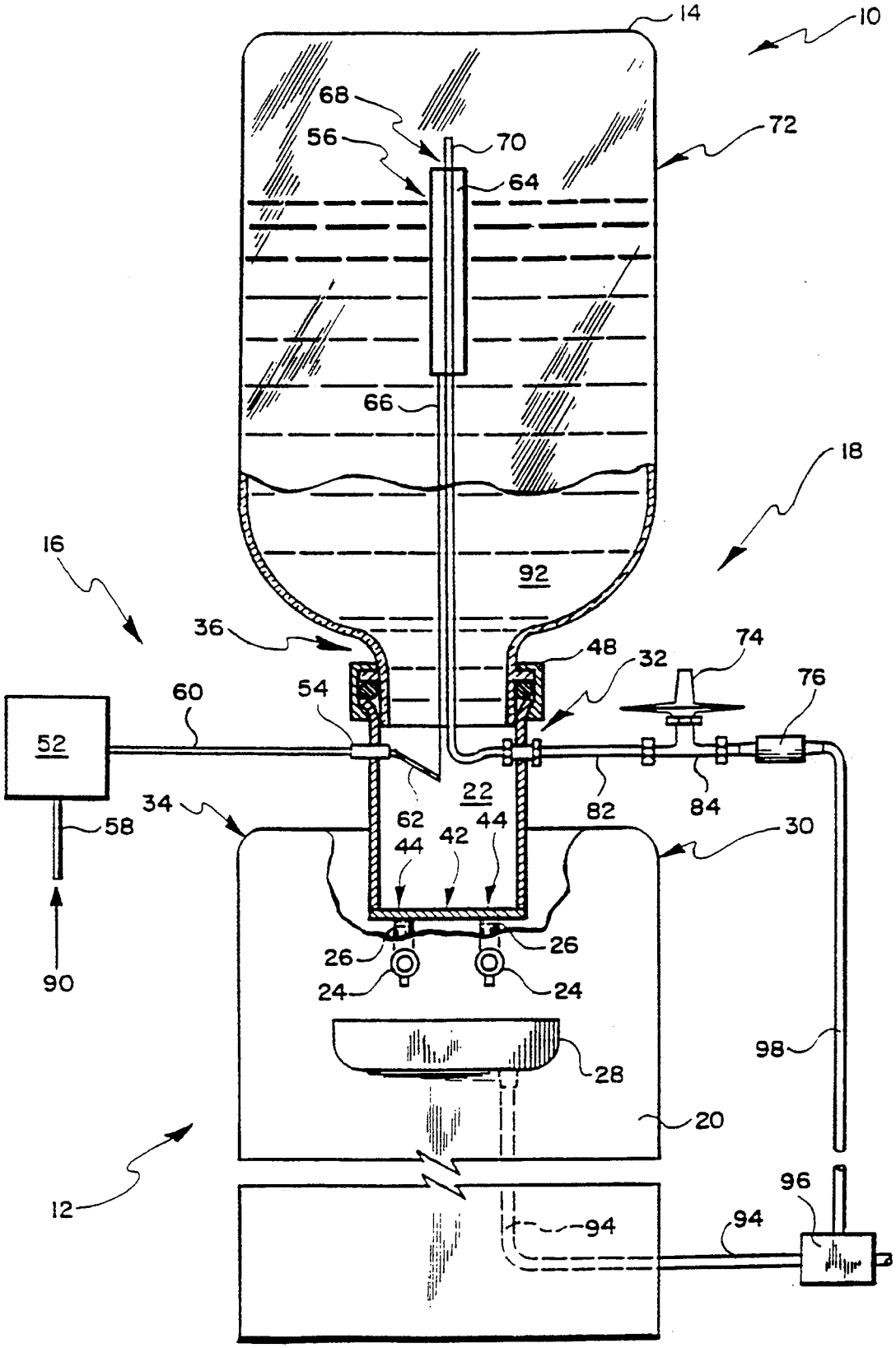
FIG. 1 is a partial cross-section view of a self-filling bottled-water cooler according to the present invention.

Referring now to the drawings wherein like reference numerals designate corresponding or similar elements throughout the several views, an exemplary self-filling bottled-water cooler 10 according to the present invention is depicted in FIG. 1. The self-filling bottled-water cooler 10 includes a dispensing system 12, a water bottle 14, a water inlet system 16 and a venting system 18.

The dispensing system 12 includes a free-standing cabinet body 20, a water tank 22 located in the upper portion 30 of the cabinet body, at least one tap 24 mounted on the front of the cabinet body 20 and plumbing connections 26 from the water tank 22 to the taps 24 to permit water to flow from the water tank through the taps when the taps are opened. The dispensing system can also include a heating and/or cooling system (not shown) to vary the temperature if of water dispensed through the taps. For example, a heating system can be included so that one tap dispenses hot water for coffee, tea or soup, and a cooling system can be included so that another tap dispenses cold water for cold drinks. Such heating and cooling systems are known in the industry and therefore are not described here.

The cabinet body 20 can also include a spill tray 28 mounted under the taps 24 to catch water spilled from the taps. Such spill trays are also known in the industry. A spill drain line 94 can be included in the cabinet body to drain spilled water from the spill tray 28 to a drain pump 96.

The cabinet body 20 is self-standing and must be configured to stably support the water bottle 14 filled with water. The cabinet body can be formed of sheet metal, plastic or other rigid materials.

The water tank 22 is located within the upper portion 30 of the cabinet body 20 such that an upper section 32 of the water tank extends upward beyond the top surface 34 of the cabinet body to mate with the neck 36 of the water bottle 14. Alternatively, the water tank 22 can be located completely within the upper portion 30 of the cabinet body 20 such that the neck 36 of the water bottle 14 projects downward into the upper portion 30 of the cabinet body to mate with the upper section 32 of the water tank. The water tank 22 can be made of stainless steel or any other sturdy material non-reactive with water and has a circular horizontal cross section. The upper edge 38 of the water tank is flared to accommodate an O-ring seal 40. The bottom surface 42 of the tank has at least one outlet 44 to allow water in the tank to flow through the plumbing connections 26 to the taps 24 for dispensing.

Figure 2:
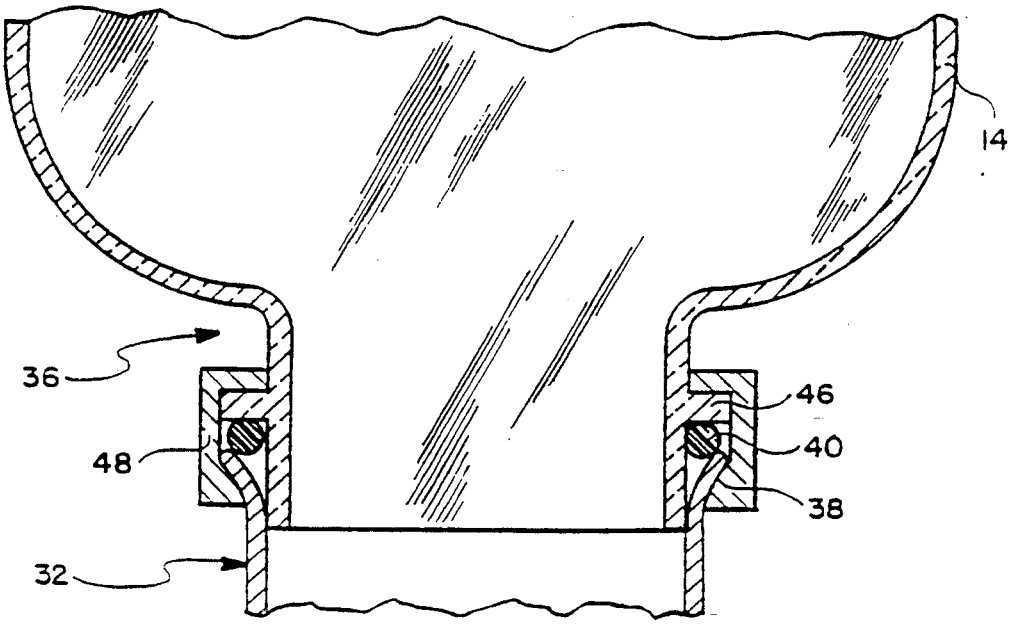
FIG. 2 is a cross-section view of the self-filling bottled-water cooler of FIG. 1 showing attachment of the bottle to the upper section of the water tank.

The water bottle 14 can be made of glass, plastic or any other transparent rigid material and is securely attached in an inverted position to the upper section 32 of the water tank of the cabinet body 20. As can best be seen in FIG. 2, the water bottle 14 is formed with a straight neck 36 having an annular flange 46. The outside diameter of the straight neck 36 is selected to be slightly smaller than the inside diameter of the upper section 32 of the water tank such that its neck 36 snugly slides into the inside of the upper section 32 of the water tank 22. As can be seen in the figure, the flared upper edge 38 of the water tank cooperates with the annular flange 46 formed on the neck of the water bottle and an O-ring seal 40 placed between the flared upper edge 38 and the annular flange 46 to seal the joint between the bottle 14 and the water tank 22. Clamps 48 engage the annular flange 46 and the flared upper edge 38 to secure the bottle onto the water tank 22 and to provide additional pressure on the O-ring seal 40 to seal the joint.

The water inlet system 16, which supplies purified water to the interior of the water bottle, includes water inlet lines 58 and 60, a reverse osmosis, carbon block or other water purifier 52, an inlet valve 54 and a float mechanism 56. A first water inlet line 58 connects to a tap-water or other continuous water source (not shown) to supply water 90 to the water purifier 52, which purifies the water. The water purifier 52 can purify the water to greater than 99% purity, which is greater than the purity of bottled water supplied for conventional bottled water coolers. A second water inlet line 60 connects the water purifier 52 to the inlet valve 54 to supply purified water to the water tank 22 of the dispensing system 12. The inlet valve 54 is mounted on the water tank 22 and regulates the flow of purified water into the water tank. The inlet valve 54 is biased in an open position to normally allow the purified water to enter the water tank 22. A lever 62 on the inlet valve 54 moves upward in a vertical arc to close the valve to control the flow of purified water into the water tank 22.

The float mechanism 56 includes a tubular float 64 and a thin wire, filament or other linkage 66. The float 64 is made of polycarbonate and has an axial hole 68 through its center. The float 64 is slidably disposed on an overflow tube 70 which extends vertically in the bottle 14 from the water tank 22 to the upper portion 72 of the bottle. The overflow tube 70 passes through the axial hole 68 in the float such that the float 64 is free to slide vertically on the tube 70. The wire, filament or other linkage 66 connects the float to the lever 62 of the inlet valve 54 to control the position of the lever and therefore to regulate the valve.

Figure 3:
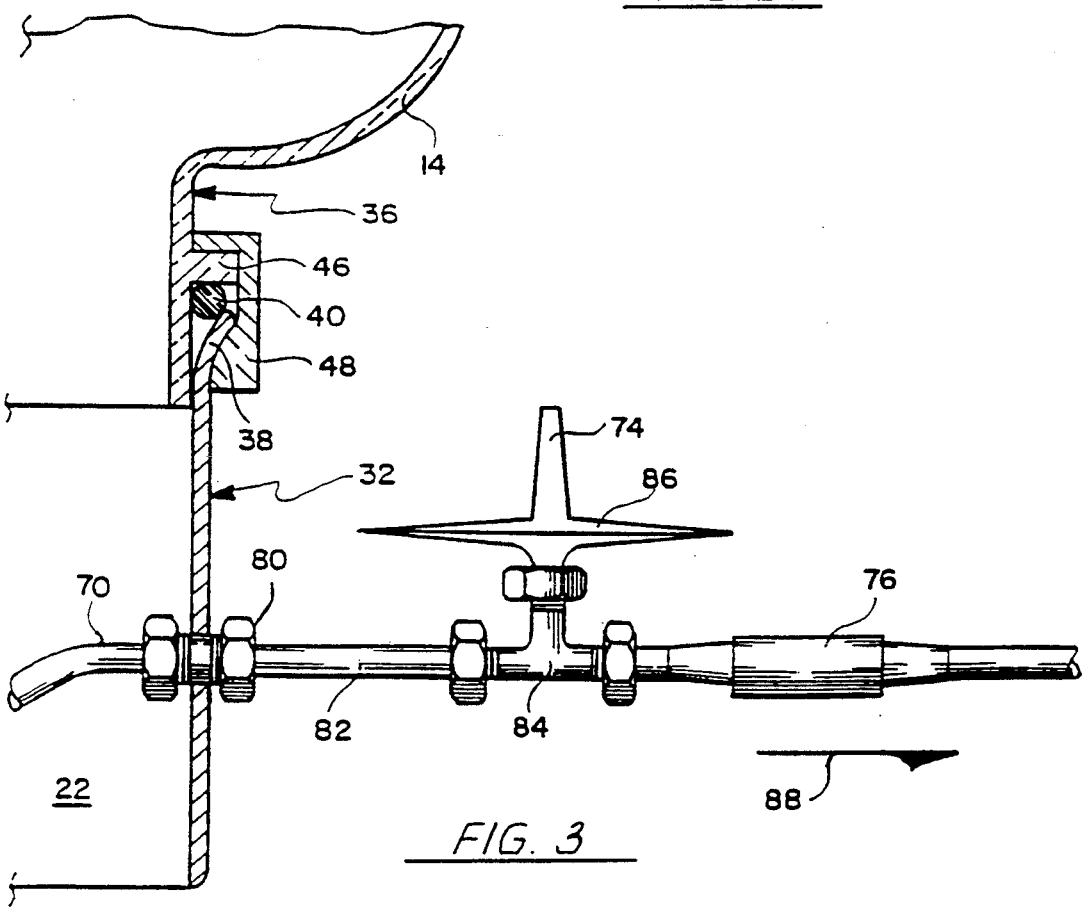
FIG. 3 is a partial cross-sectional view of the self-filling bottled-water cooler of FIG. 1 showing a portion of the venting system.

The venting system 18 includes the overflow tube 70, an air vent 74 having a hydrophobic bacteria filter, a check valve 76, a drain pump 96 and drain line plumbing 80, 82, 84, and 98. The overflow tube 70 is made of plastic, stainless steel or any other rigid material non-reactive with water and is rigidly attached to the water tank 22 by conventional plumbing fixtures 80 which that the overflow tube 70 provides a passage from the upper portion 72 of the water bottle down through the bottle 14 and out through the water tank 22. As can be seen in FIG. 3, a drain line 82 and a "T" fixture 84 connect the overflow tube 70 at the plumbing fixtures 80 on the water tank 22 to the air vent 74 and check valve 76. A drain line 98 connects the check valve 76 to the drain pump 96. The drain pump 96 pumps spilled water collected by the spill tray 28 and overflow water collected by the venting system to a drain destination.

The air vent 74 includes a hydrophobic bacteria filter in a housing 86 to prevent bacteria and other contaminants from entering the water supply through the air vent. Typically, a 0.22 microfilter is used. The check valve 76 only permits fluid flow in the direction of the arrow 88 and therefore also prevents contaminants from backflowing through the venting system into the water supply.

The venting system 18 acts as an emergency overflow drain to prevent the water bottle 14 from overfilling. The venting system 18 also provides an air vent to the upper portion 72 of the water bottle above the water level in the bottle. Venting of the bottle above the water level is necessary to prevent a change in air pressure within the bottle when water is added to the bottle or dispensed through the taps 24. Without venting of the bottle, air pressure would build in the bottle as water is added to the bottle until the pressure is great enough to prevent additional water from entering the bottle. Therefore, without venting, the bottle would never fill. Conversely, without venting of the bottle, air pressure would drop in the bottle as water was dispensed through the taps 24 until the drop was great enough to prohibit flow of water through the taps. Therefore, without venting, the flow of water through the taps would be inhibited.

As can be seen from the figures, water 90 enters the first inlet line 58 of the cooler and is purified in the water purifier 52. The purified water 92 passes through the second inlet line 60 and the inlet valve 54 and fills the water tank 22 and the water bottle 14 until the water 92 in the bottle reaches the desired full level, raises the float 64 and closes the inlet valve 54. As the water 92 fills the water bottle 14, air exits the bottle through the venting system 18 to keep the air pressure in the bottle constant. The water level then remains constant until a user dispenses water from the cooler.

When a tap 24 is opened, water is dispensed from the water bottle 14 and the water tank 22 through the tap. This causes the water level in the bottle to drop which in turn causes the float 64 to lower and therefore to open the inlet valve 54 once again to allow more purified water 92 to enter the water tank 22 and water bottle 14 to restore the water level in the bottle to its original place. As the water level in the bottle drops, air enters the bottle through the venting system 18 to keep the air pressure in the bottle constant.

If the inlet valve 54 malfunctions by remaining in the open position and the water level within the bottle rises above the normal full level of the bottle, purified water 92 flows into the overflow tube 70 and passes out of the cooler without causing water pressure to build in the bottle.

The teachings of the present invention can also be used to convert existing conventional bottled-water coolers into self-filling bottled-water coolers. In an alternative embodiment of the present invention, most shown in FIGS. 4, 5 and 6, an apparatus 100 for converting a conventional bottled-water cooler into a self-filling bottled-water cooler is provided. The conversion apparatus 100 includes a water bottle 102 similar to the water bottle 14 described above. Onto the water bottle 102, are mounted a water inlet system 104 and a venting system 106, similar to the water inlet system 16 and venting system 18 which in the embodiment of FIG. 1 are mounted onto the water tank 22 of the cabinet body 20. The conversion apparatus 100 easily converts a conventional bottled-water cooler into a self-filling bottled-water cooler by replacing the interchangeable bottle of the conventional bottled-water cooler with the conversion apparatus 100, as described below.

The water bottle 102 is essentially the same as water bottle 14 described above except that a cutout 108 is provided in the water bottle for mounting the water inlet system 104 and the venting system 106. The area of the water bottle around the cutout 108 can be opaque and a dark color, such as black, to mask connection of the water inlet system 104 and the venting system 106 to the water bottle 102. Also, in a small hole in the center 110 through the top wall 112 of the water bottle is mounted a small plug 114 having a tubular portion 116 with an open end 118 extending into the interior 120 of the water bottle 102 for receiving the upper end 122 of the overflow tube 124, as will be described in more detail below.

Like water bottle 14 described above, water bottle 102 is formed with a straight neck 126 having an annular flange 128. The outside diameter of the straight neck 126 is selected to be slightly smaller than the inside diameter of the water tank 212 of the bottled-water cooler to be converted such that the neck 126 will snugly slide into the inside of the water tank 212.

Figure 5:
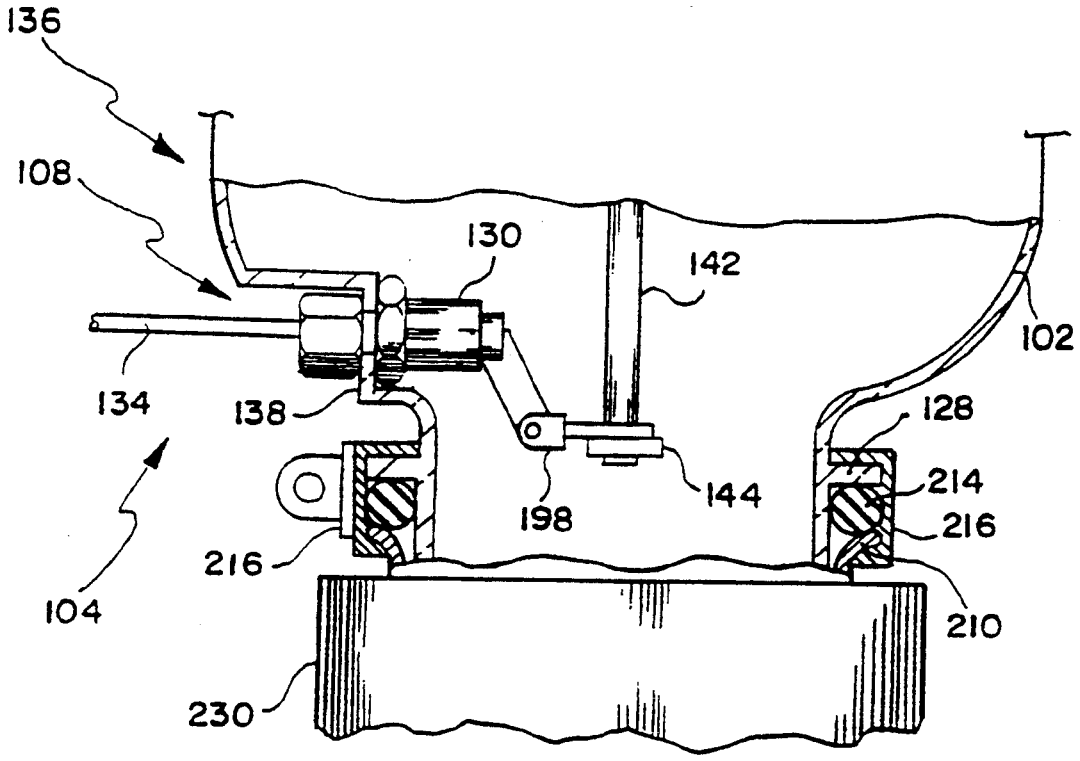
FIG. 5 is a partial cross-section view of the apparatus of FIG. 4 showing a portion of the water inlet system.

The water inlet system 104 includes an inlet valve 130 and a float mechanism 132. The inlet valve 130, which best can be seen in FIG. 5, is fluidically connected by a water inlet line 134 to a water purifier (not shown in FIG. 5, but such as water purifier 52 of the embodiment of FIG. 1) and ultimately to a tap-water or other continuous water source (not shown in FIG. 5, but as shown and described for the embodiment of FIG. 1). The inlet valve 130 is mounted on the bottom portion 136 of the water bottle through flat surface 138 in cutout 108. The inlet valve 130 regulates the flow of purified water into the water bottle and operates in a similar manner to the inlet valve 54 described above.

Figure 4:
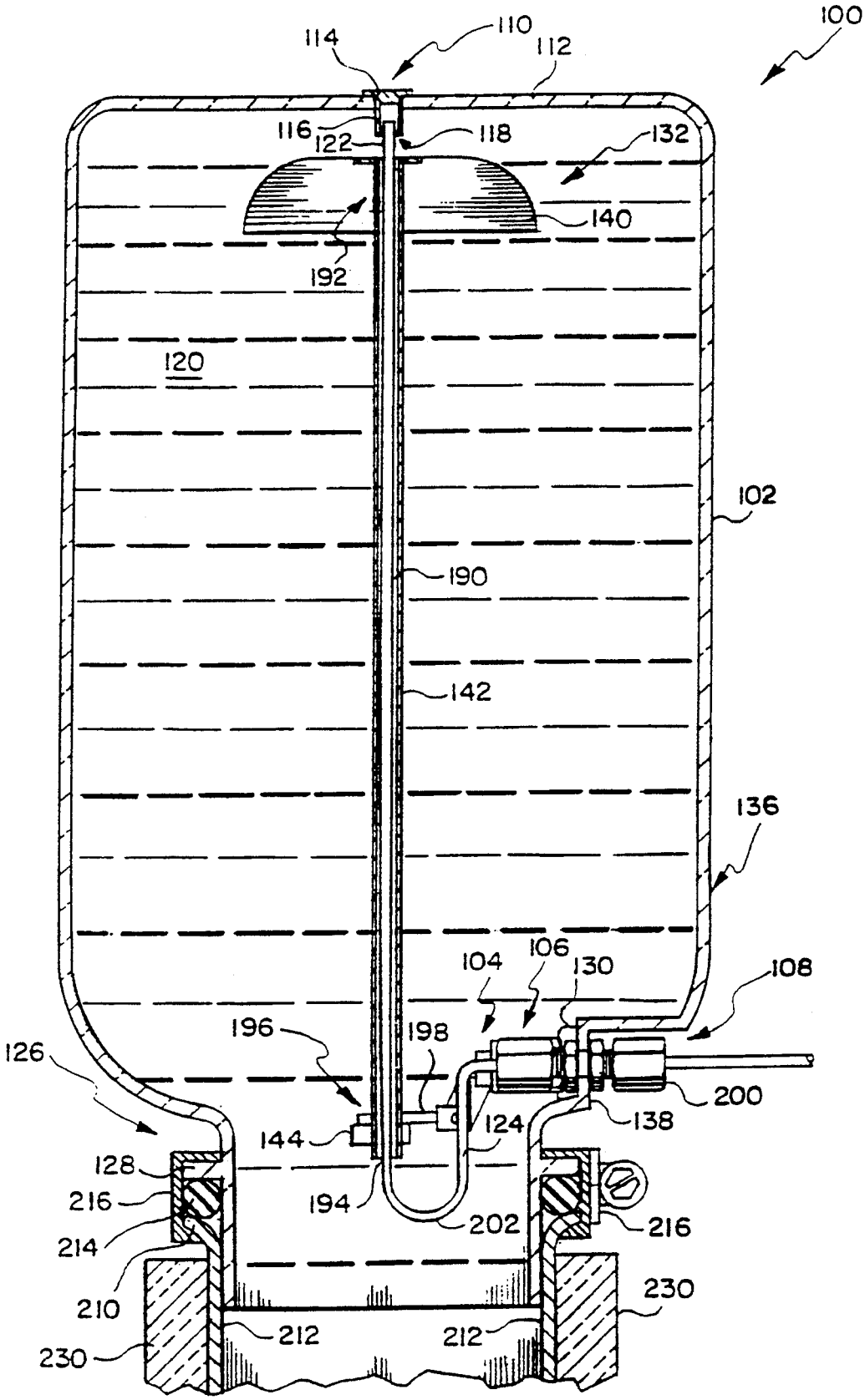
FIG. 4 is a cross-section view of an apparatus for converting a conventional bottled-water cooler into a self-filling bottled-water cooler according to the present invention.

The float mechanism 132, which best can be seen in FIG. 4, includes an umbrella float 140, a tubular support 142 and a catch 144. As can best be seen in FIG. 7, the umbrella float 140 is made of a rigid, airtight plastic or other suitable material non-reactive with water and has a curved semi-spherical body 146 with an open bottom end 148. Typically, the umbrella float body 141 is made of a transparent material so that it is nearly invisible when used within the water bottle 102. Through the top wall 150 of the float body 146, a support plug 152 is located which has an axial hole 154 perpendicular to the plane, represented by dashed line 156, of the open bottom end 148 of the float body 146. As further described below, the axial hole 154 provides the attachment point for the umbrella float 140 to the tubular support 142. The support plug 152 is thicker than the top wall 150 of the umbrella float body 146 and must provide a sufficiently sized inside surface 158 for firm attachment of the umbrella float 140 to the tubular support 142. Typically, the support plug 152 will be made of the same transparent material as the umbrella float body 146, but can be made of any rigid, airtight plastic or other suitable material non-reactive with water and capable of being bonded to the float body 146. The axial hole 154 in the support plug 152 must be of sufficient diameter to provide a snug fit around the outside of the cross section of the tubular support 142.

In an alternative embodiment, the umbrella float 140 can be configured as shown in FIG. 8. As shown in the figure, the alternative embodiment 160 of the umbrella float is flatter than the umbrella float 140 of FIG. 7 and generally has a disc shape. The alternative embodiment umbrella float 160 is made of the same rigid materials as the umbrella float 140 of FIG. 7 and also typically is transparent. The alternative embodiment umbrella float 160 has a flat upper wall 162 integrally formed with a short, ring-shaped outer sidewall 164. A rounded edge 166 joins the upper wall 162 with the outer sidewall 164. As with the umbrella float of FIG. 7, the bottom 168 of the alternative embodiment umbrella float 160 is open.

An axial hole 170 having a tubular sidewall 172 extends downward from the upper wall 162 through the inside 174 of the alternative embodiment umbrella float 160. The tubular sidewall 172 of the axial hole 170 is integrally formed with the upper wall 162 of the float and the bottom edge 176 of the tubular sidewall 172 extends below the bottom edge 178 of the outer sidewall 164 of the float. As with the umbrella float of FIG. 7, the axial hole 170 is used to attach the alternative embodiment umbrella float 160 to the tubular support 142. Thus, the inside diameter of the axial hole 170 must be of sufficient size to snugly fit over the outside cross section of the tubular support 142. Also, the length of the tubular sidewall 172 must provide a sufficiently sized inside surface 180 for firm attachment of the alternative embodiment umbrella float 160 to the tubular support 142.

Typically, the overall diameter 182 of the alternative embodiment umbrella float 160 is greater than the overall diameter 184 of the umbrella float 140 of FIG. 7; however, the height 186 of the outer sidewall 164 of the alternative embodiment umbrella float 160 is significantly less than the overall height 188 of the umbrella float 140 of FIG. 7. Thus, an advantage of the alternative embodiment umbrella float 160 over the umbrella float 140 of FIG. 7 is that the lower height 186 of the outer sidewall of the alternative embodiment umbrella float 160 coupled with its larger overall diameter 182 gives the alternative embodiment umbrella float 160 the same buoyancy as the umbrella float 140 of FIG. 7, yet because of the lower profile of the alternative embodiment umbrella float 160, it is less noticeable in the top of the water bottle 102. Also, because the tubular sidewalls 176 of the axial hole 170 of the alternative embodiment umbrella float 160 extend downward below the bottom edge 178 of the outer sidewall 164 when the alternative embodiment umbrella float 160 is used, an airtight chamber is integrally formed in the inside 174 of the float without any need to provide an airtight seal between the outside of the tubular support 142 and the inside surface 180 of the axial hole.

As best can be seen in FIG. 4, the tubular support 142 is disposed around the upstanding portion 194 of the overflow tube 124. The tubular support 142 supports the umbrella float 140 within the water bottle 102, provides a bearing surface 190 for the umbrella float 140 to ride upon in a vertical path within the water bottle 102, and links the umbrella float 140 to the inlet valve 130. The tubular support 142 is made of a rigid plastic or other suitable material non-reactive with water. The tubular support 142 is formed into a thin tube and typically is transparent. The length of the tubular support is determined by placement of the catch 144 described below. The upper end 192 of the tubular support 144 firmly attaches to the inside surface 158 of the axial hole 154 of the umbrella float 140. A water-insoluble adhesive or other water-insoluble means is used to connect the upper end 192 of the tubular support 142 to the umbrella float 140. Unless the umbrella float 160 of FIG. 8 is used in the conversion apparatus, the seal between the outside surface of the upper end 192 of the tubular support 142 and the inside surface 158 of the axial hole 154 must be airtight.

As the inside surface of the tubular support 142 provides a bearing surface 190 for the umbrella float 140 to ride upon within the water bottle 102, the inside diameter of the tubular support 142 must be greater than the outside diameter of the overflow tube 124, described below, and must be of sufficient size so that the tubular support 142 can easily slide in a vertical direction along the upstanding portion 194 of the overflow tube 124.

To the bottom end 196 of the tubular support 142 is attached the catch 144. The catch 144 trips the lever 198 of the inlet valve 130 to stop the flow of water into the water bottle 102 when the level of water in the water bottle 102 reaches the desired full level and raises the umbrella float 140. The catch 144 is made of a ring of plastic or other suitable material press fit around the bottom end 196 of the tubular support 142. An insoluble adhesive can also be used to attach the catch 144 around the bottom end 144 of the tubular support 142. The catch 144 must be attached to the bottom end 196 of the tubular support 142 at a distance from the umbrella float 140 sufficient to trip the lever 198 of the inlet valve 130 and close the valve when the water in the water bottle 102 reaches the desired full level and raises the umbrella float 140.

The venting system 106 is essentially the same as the venting system 18 described above, except that the venting system 106 is mounted onto the bottom portion 136 of the water bottle 102 by conventional plumbing fixtures 200 which pass through flat 138 in cutout 108. The upstanding portion 194 of the overflow tube 124 must be straight and have sufficient length to allow the float mechanism 132 to vertically slide along the upstanding portion 194 and have enough movement in the vertical direction to close the inlet valve 130 when the water level in the water bottle 102 reaches the desired full level. Thus, in the conversion apparatus B embodiment shown in FIG. 4, the bottom portion of the overflow tube 124 has a U-shaped portion 202 to provide an upstanding portion 194 of sufficient length.

In the conversion apparatus shown in FIG. 4, the upper end 122 of the overflow tube 124 is held in the tubular portion 116 of the small plug 114 mounted in the center 110 of the top wall 112 of the water bottle 102. The tubular portion 116 of the small plug 114 provides support to the upper end 122 of the overflow tube 124. The tip of the upper end 122 overflow tube 122 merely rests within the tubular portion 116 of the small plug 114 and is not affixed within the tubular portion 116 in any manner. A clearance is provided between the outside surface of the tip of the upper end if 122 of the overflow tube 124 and the inside surface of the tubular portion 116 of the small plug 114 so that air and, if water overfills the water bottle 102, water can freely flow between the inside 120 of the water bottle 102 and the inside of the overflow tube 124.

Figure 6:
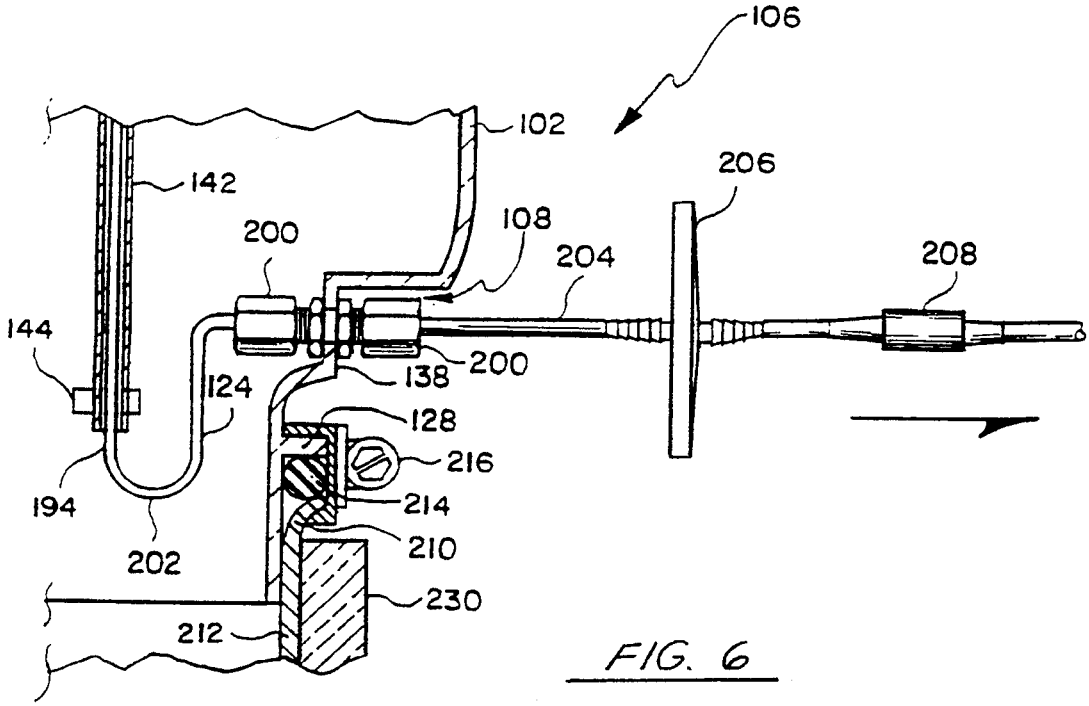
FIG. 6 is a partial cross-section view of the apparatus of FIG. 4 showing a portion of the venting system.

As can best be seen in FIG. 6, as in the venting system 18 of the embodiment of FIG. 1, the overflow tube 124 is connected through conventional plumbing fixtures 200 and drain line 204 to a bacteria filter 206, a check valve 208 and ultimately to a drain pump and a drain source (not shown). The bacteria filter 206 can be of a hydrophilic type as shown in FIG. 6, or of a hydrophobic type use with a "T" Fixture 84, housing 86 and air vent 74 as shown in FIG. 3. The function and operation of the venting system 106 in the conversion apparatus 100 embodiment is the same as the function and operation of the venting system 18 in the self-filling bottled-water cooler 10 embodiment of FIG. 1.

A conventional bottled-water cooler is converted to a self-filling bottled-water cooler with the conversion apparatus 100 by removing the interchangeable bottle of the conventional bottled-water cooler, removing the bottle seat from the top of the cooling-dispensing unit of the conventional bottled-water cooler to expose the top of the water tank of the cooler, and attaching the conversion apparatus 100 to the tank of the cooler.

The conversion apparatus 100 attaches to the tank of a conventional bottled-water cooler in the same manner as water bottle 14 attaches to upper section 32 of water tank 22 of the embodiment of FIG. 1. As can best be seen in FIG. 4, the flared upper edge 210 of water tank 212 of the conventional bottled-water cooler cooperates with the annular flange 128 formed on the neck 126 of the water bottle 102 and an O-ring seal 214 placed between the flared upper edge 210 and the annular flange 128 to seal the joint between the bottle 102 and the water tank 212. A worm-gear clamp 216 engages the annular flange 128 and the flared upper edge 210 to secure the bottle 102 onto the water tank 212 and to provide additional pressure on the O-ring seal 214 to seal the joint.

As some conventional bottled-water coolers do not have a water tank with a flared upper edge, an adapter such as the adapter 218 shown in FIG. 9, can be provided to facilitate attachment of the conversion apparatus 100 to the water tank of the conventional bottled-water cooler. Adapter 218 is ring shaped and made of plastic, stainless steel or any other suitable rigid material non-reactive with water. The upper edge 220 of the adapter 218 is flared to accommodate an O-ring seal. The exact dimensions for a particular use will depend upon the particular dimensions and characteristics of the tank of the bottled-water cooler to be converted; however, for illustrative purposes, the adapter 218 shown in FIG. 9 has a height of two inches, an inside diameter, measured at the lower edge 222 of six and one-quarter inches, an outside diameter, measured from edge to edge of the flared upper edge 220, of six and five-eighths inches, a radius of one quarter inch for the flared portion of the upper edge 220 and a wall thickness of one sixty-fourth inch.

Figure 10:
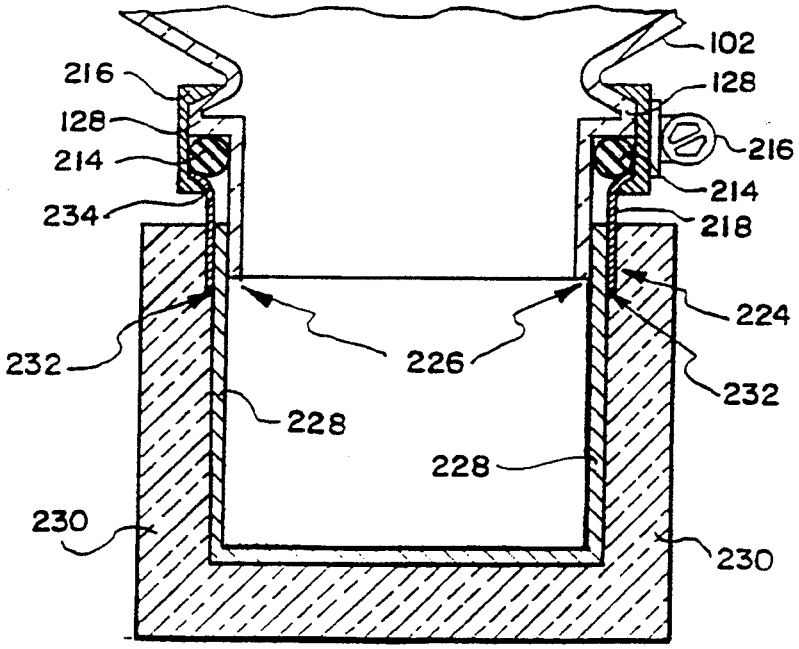
FIG. 10 is a cross-section view showing use of the adapter of FIG. 9 in conjunction with the apparatus of FIG. 4.

As shown in FIG. 10, the lower portion 224 of the adapter 218 is slipped over the outside of the upper section 226 of the water tank 228 of the bottled-water cooler to be converted between the upper section 226 and the foam insulation 230 surrounding the water tank. The inside diameter of the adapter 218 must be sufficient to provide a secure fit at the area 232 between the outside surface of the upper section 226 of the water tank 228 and the inside surface of the lower portion 224 of the adapter 218. A suitable water-insoluble adhesive can be used to securely fasten the lower portion 224 of the adapter 218 to the outside surface of the upper section 226 of the water tank 228 and to prevent water leakage. When attached to the water tank 228 as described immediately above, the adapter provides a flared upper edge 234 for mating with the O-ring seal 214 of the water bottle 102. Connection of the water bottle 102 to the adapter 218 and the upper section 226 of the water tank 228 is completed just as described above for a water tank having an upper section with a flared edge.

Once converted, a conventional bottled-water cooler converted to a self-filling bottled-water cooler with the conversion apparatus 100 functions in the same manner as described above for the self-filling bottled-water cooler 10 embodiment shown in FIG. 1.

Figure 11:
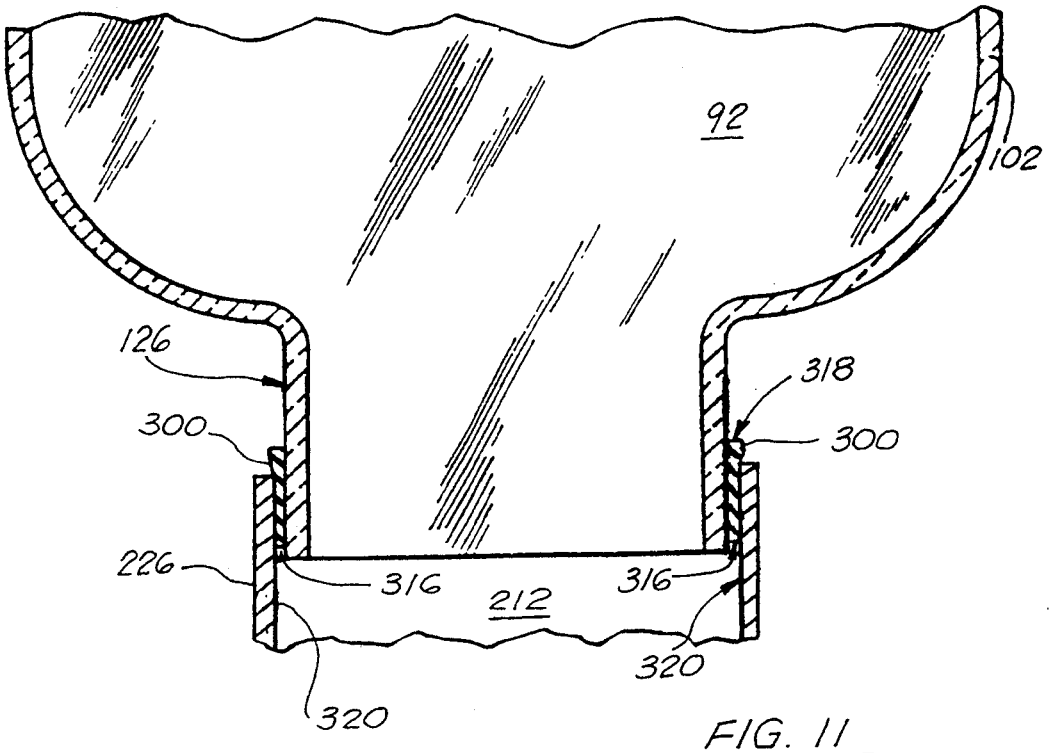
FIG. 11 is a partial cross-sectional view of the self-filling bottled-water cooler apparatus of FIG. 4, showing an alternative neck seal.

Referring now to FIG. 11, an alternative embodiment for mating the water bottle 102 with the upper section 226 of the water tank 212 is shown. The bottle 102 with a straight neck 126 is depicted with a flat seal 300 secured to the neck 126. As can be seen in the figure, the upper section 226 of the water tank 212 cooperates with the flat seal 300 to form a watertight joint between the bottle 102 and the water tank 212.

Figure 12:
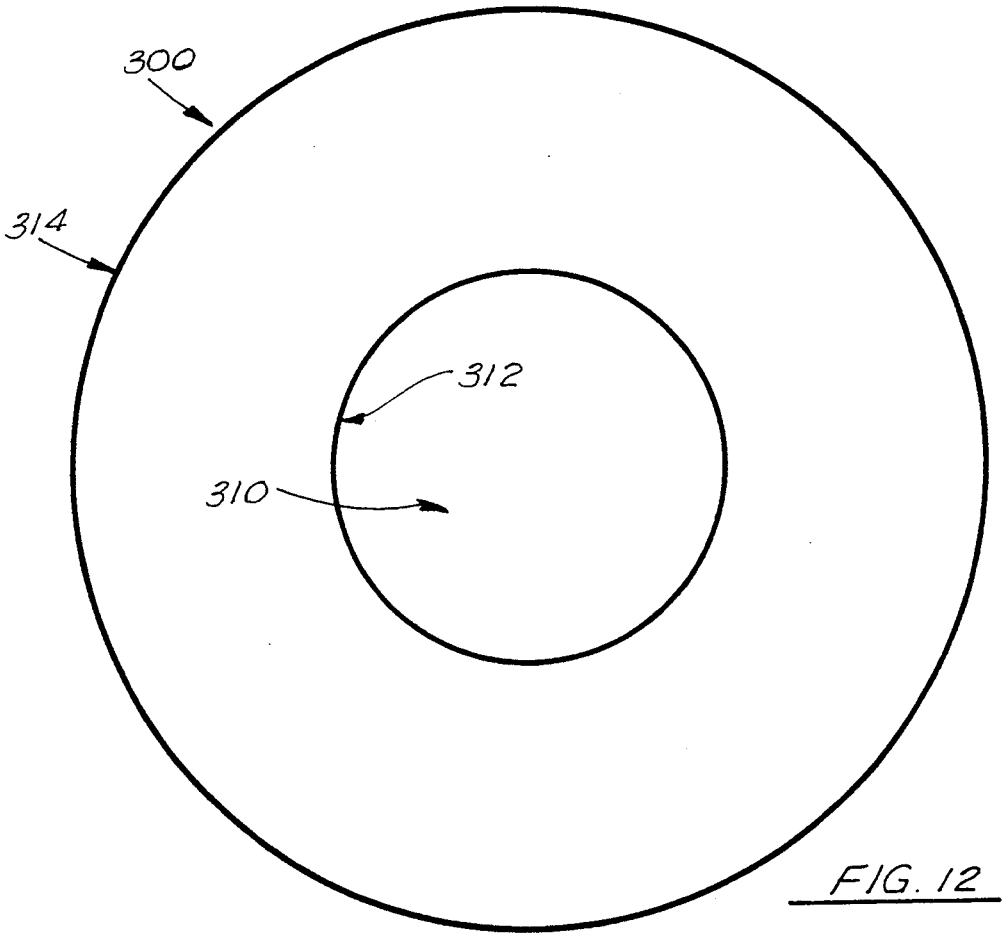
FIG. 12 is a plan view of the neck seal of FIG. 11.

The flat seal 300 performs the same function of forming a watertight seal, as that of the O-ring seal 214, flange 128, flared upper edge 210 and clamp 216, depicted in FIG. 4. The structural composition of the seal 300 is better understood with reference to FIG. 12. The seal 300 is a flexible elastomeric "pancake," or disk, having a central hole or opening 310. In the preferred embodiment, the seal 300 is made of silicone rubber. Both sides of the seal 300 are generally smooth.

The seal 300 is flat when not installed on the neck 126. To install the seal 300, the central opening 310 of the seal 300 is stretched over the neck 126 of the bottle 102, with the one side of the seal 300 pressed against the outer surface of the neck 126. Thus, when the seal 300 is installed, it becomes cylindrical and readily conforms to the size and shape of the neck 126. The elastic tension of the seal 300, combined with the surface friction between the generally smooth surface of the seal 300 and the neck 126 ensure that the seal remains secured to the neck. Because the inside circumference 312 of the seal 300, when flat before installation, is less than the outside circumference 314, when the seal 300 is stretched over the neck 126 of the bottle 102, the inside circumference 312 stretches more than the outside circumference 314. Thus, when the seal 300 is installed on the neck 126, because of such differential stretching, the thickness of the seal 300 near the mouth of the neck 126 at the lower edge 316, which corresponds to the inside circumference 312 of the seal, is less than the thickness of the seal 300 at the upper edge 318, which corresponds to the outside circumference 314 of the seal. Accordingly, this gives the seal, when installed, a tapered or wedge effect. Such a taper or wedge effect aids insertion of the neck 126 into the upper section 226 of the water tank 221 and compensates for imperfections in fit.

After the seal 300 is stretched over the neck 126 of the water bottle 102, the neck 126 with the seal 300 is firmly pressed inside the upper section 226 of the water tank 221. The elastic properties of the seal 300 also conform the seal to the size and shape of the inside surface 320 of the upper section 226 of the water tank 212. Such elastic properties combined with the friction between the generally smooth surface of the seal and the inside surface 320 of the water tank 212 ensure that the seal 300 firmly attaches the water bottle 102 to the water tank 212 without water leakage. Such an arrangement provides an uncomplicated, yet effective, watertight seal which uses only friction and the weight of the bottle 102 and water 92 to provide the necessary sealing forces. Thus, the expense and complication of use of a clamping or other fastening device, such as a worm-gear clamp 216, is avoided.

Figure 13:
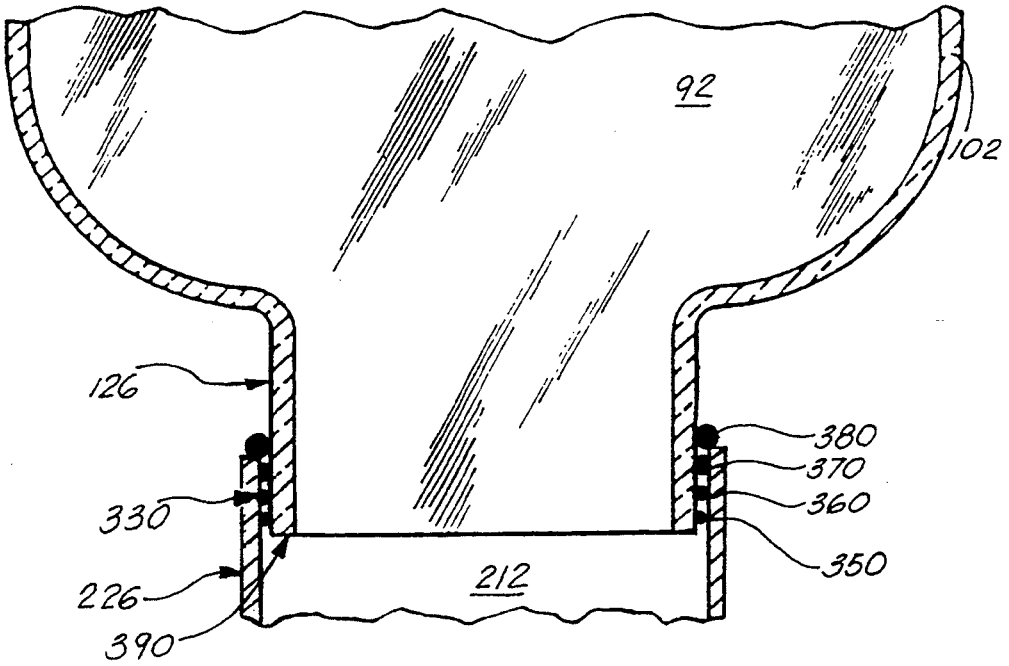
FIG. 13 is a partial cross-sectional view of an alternative embodiment of the neck seal of FIG. 11.
Figure 14:
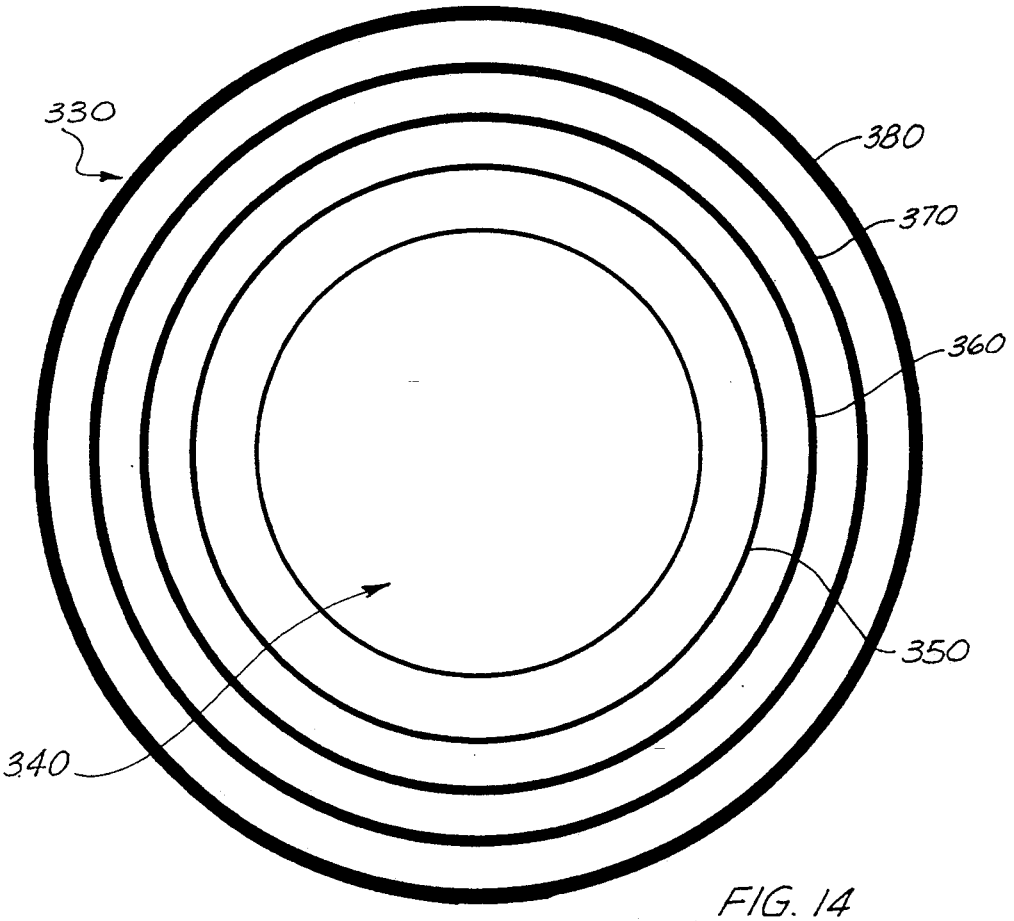
FIG. 14 is a plan view of the neck seal of FIG. 13.

An alternative embodiment of the seal 300 is shown in FIGS. 13 and 14. Referring particularly to FIG. 14, the alternative embodiment is shown as a ribbed seal 330, also formed from an elastomeric "pancake", or disk, having a central hole or opening 340. Unlike the flat seal 300, the ribbed seal 330 has rounded ridges 350, 360, 370, 380 disposed concentrically on one side of the seal 330, around the hole 340. Proceeding outward from the hole 340, each successive ridge is wider and thicker. The outermost ridge 380 is the largest. The opposite side of the seal 330 is generally smooth. Like the flat seal 300, in the preferred embodiment, the ribbed seal 330 is made of silicone rubber.

Installation of the ribbed seal 330 is performed in the same manner as the installation of the flat seal 300 described above. As with the flat seal 300, the generally smooth side of the ribbed seal 330 is pressed against the outer surface of the neck 126.

When the ribbed seal 330 is installed, the outermost ridge 380, which is the widest and thickest of the ridges, is uppermost located on the neck 126 of the water bottle 102. Thus, the successively narrower and thinner ridges 370, 360 and 350 are successively located lower on the neck 126 and closer to the edge 390 of the neck. This arrangement of the ridges 350, 360, 370, 380 allows the ridges to wipe the inside surface 320 of the upper section 226 of the water tank 212 and gives the seal 330 an increased taper or wedge effect when the seal is properly installed on the neck 126.

The use and operation of the ribbed seal 330 are similar to the use and operation of the flat seal 300 described above.

A variety of modifications and variations of the present invention are possible in light of the above teachings. It therefore should be understood that the present invention may be practiced otherwise than as specifically described above and that the scope of the present invention is only defined by the following claims.

I claim:

1. An apparatus for converting a conventional bottled-water cooler having a water tank with an upper open section into a self-filling bottled-water cooler, comprising:

a water bottle having at a lower portion a neck mountable to the water tank such that water freely flows between the water bottle and the water tank;

a water inlet system partially disposed within said water bottle and connected to the water bottle at said lower portion, wherein said inlet system includes a water purifier fluidically connectable to an external water source, and wherein said inlet system supplies pure water to the water bottle and controls the flow of pure water into the water bottle to allow the pure water to fill the water bottle when the pure water within the water bottle is below a desired full level and to stop the flow of pure water into the water bottle when the pure water is at or above the desired full level;

a venting system partially disposed within said water bottle and connected to the water bottle at said lower portion, wherein said venting system prevents change in air pressure within the water bottle when the level of water in the bottle changes;

wherein the neck of the water bottle, having a seal disposed thereon, fits within the upper open section of the water tank such that the upper open section of the tank cooperates with said seal to mount said water bottle onto said water tank and to seal said water bottle to said water tank;

wherein said seal includes an elastomeric annular body having a first side elastically held in intimate contact with said neck, and a second side elastically held in intimate contact with said tank by friction and the weight of said bottle; and wherein said lower portion of said water bottle includes a cut-out and said water inlet system and said venting system are connected to the water bottle at said cut-out.

2. An apparatus for converting a conventional bottled-water cooler having a water tank with an upper open section into a self-filling bottled-water cooler, comprising:

a water bottle having at a lower portion a neck mountable to the water tank such that water freely flows between the water bottle and the water tank;

a water inlet system partially disposed within said water bottle and connected to the water bottle at said lower portion, wherein said inlet system includes a water purifier fluidically connectable to an external water source, and wherein said inlet system supplies pure water to the water bottle and controls the flow of pure water into the water bottle to allow the pure water to fill the water bottle when the pure water within the water bottle is below a desired full level and to stop the flow of pure water into the water bottle when the pure water is at or above the desired full level;

a venting system partially disposed within said water bottle and connected to the water bottle at said lower portion, wherein said venting system prevents change in air pressure within the water bottle when the level of pure water in the bottle changes;

wherein the neck of the water bottle, having a seal disposed thereon, fits within the upper open section of the water tank such that the upper open section of the tank cooperates with said seal to mount said water bottle onto said water tank and to seal said water bottle to said water tank;

wherein said seal includes an elastomeric annular body having a first side elastically held in intimate contact with said neck, and a second side elastically held in intimate contact with said tank by friction and the weight of said bottle;

wherein said venting system includes a rigid tube disposed within the water bottle and having a vertically upstanding portion with an open end above the desired full level of the water bottle; and wherein said water bottle includes a plug having a tubular portion through a top wall of the water bottle, said tubular portion having an open end extending into the interior of the water bottle, and wherein said open end of said vertically offstanding portion of said rigid tube is supported within the open end of the tubular portion of said plug.

3. An apparatus for converting a conventional bottled-water cooler having a water tank with an upper open section into a self-filling bottled-water cooler, comprising:

a water bottle having at a lower portion a neck mountable to the water tank such that water freely flows between the water bottle and the water tank;

a water inlet system partially disposed within said water bottle and connected to the water bottle at said lower portion, wherein said inlet system includes a water purifier fluidically connectable to an external water source, and wherein said inlet system supplies pure water to the water bottle and controls the flow of pure water into the water bottle to allow the pure water to fill the water bottle when the pure water within the water bottle is below a desired full level and to stop the flow of pure water into the water bottle when the pure water is at or above the desired full level;

a venting system partially disposed within said water bottle and connected to the water bottle at said lower portion, wherein said venting system prevents change in air pressure within the water bottle when the level of pure water in the bottle changes;

wherein the neck of the water bottle, having a seal disposed thereon, fits within the upper open section of the water tank such that the upper open section of the tank cooperates with said seal to mount said water bottle onto said water tank and to seal said water bottle to said water tank;

wherein said seal includes an elastomeric annular body having a first side elastically held in intimate contact with said neck, and a second side elastically held in intimate contact with said tank by friction and the weight of said bottle; and wherein said venting system prevents overfilling of the water bottle and includes a check valve to prevent contaminants from entering the water bottle through the venting system.

4. An apparatus for converting a conventional bottled-water cooler having a water tank with an upper open section into a self-filling bottled-water cooler, comprising:

a water bottle having at a lower portion a neck mountable to the water tank such that water freely flows between the water bottle and the water tank;

a water inlet system partially disposed within said water bottle and connected to the water bottle at said lower portion, wherein said inlet system includes a water purifier fluidically connectable to an external water source, and wherein said inlet system supplies pure water to the water bottle and controls the flow of pure water into the water bottle to allow the pure water to fill the water bottle when the pure water within the water bottle is below a desired full level and to stop the flow or pure water into the water bottle when the pure water is at or above the desired full level;

a venting system partially disposed within said water bottle and connected to the water bottle at said lower portion, wherein said venting system prevents change in air pressure within the water bottle when the level of pure water in the bottle changes;

wherein the neck of the water bottle, having a seal disposed thereon, fits within the upper open section of the water tank such that the upper open section of the tank cooperates with said seal to mount said water bottle onto said water tank and to seal said water bottle to said water tank;

wherein said seal includes an elastomeric annular body having a first side elastically held in intimate contact with said neck, and a second side elastically held in intimate contact with said tank by friction and the weight of said bottle; and wherein said venting system includes a drain pump to pump overflow water collected by the venting system to a drain destination.

5. For use in a bottled-water cooler conversion apparatus, a seal for ensuring a water tight connection between the neck of a self-filling bottle and the tank of a water cooler cabinet, comprising:

a flexible elastomer flat disk having a central opening and a flat annular body around said opening, said flat annular body having a first side including a plurality of spaced rounded ridges concentrically arranged on said flat annular body around said opening, and a generally smooth second side opposite to said first side; and wherein the thickness and width of said ridges successively increase from the ridge surrounding said opening to the outermost ridge surrounding said opening, the opening in the flat disk being smaller than the outside diameter of the neck of the self-filling bottle such that when the flat disk is manually stretched to fit the opening over the neck of the bottle and the flat disk is released, the disk assumes a cylindrical configuration with the smooth second side in engagement with the neck of the bottle.

6. An apparatus for converting a conventional bottled-water cooler having a water tank with an upper open section into a self-filling bottled-water cooler, comprising:

a water bottle having at a lower portion a neck mountable to the water tank;

a water inlet system wherein said inlet system supplies water to the water bottle and regulates the level of water in the bottle;

a seal disposed on said neck of said water bottle, wherein said neck having said seal disposed thereon, fits within the upper open section of the water tank such that the upper open section of the tank cooperates with said seal to mount said bottle onto said water tank and to seal said water bottle to said water tank;

wherein said seal includes a flexible elastomeric flat disk having a central opening and a flat annular body around said opening, said flat annular body having a first side including a plurality of spaced rounded ridges concentrically arranged on said flat annular body around said opening, and a generally smooth second side opposite to said first side; and wherein the thickness and width of said ridges of said seal successively increase from the ridge surrounding said opening to the outermost ridge surrounding said opening, the opening in the flat disk being smaller than the outside diameter of the neck of the self-filling bottle such that when the flat disk is manually stretched to fit the opening over the neck of the bottle and the flat disk is released, the disk assumes a cylindrical configuration with the smooth side in engagement with the neck of the bottle.

* * * * *